US005180183A

United States Patent [19]

Bogner

[11] Patent Number: 5,180,183

[45] Date of Patent: Jan. 19, 1993

[54] RELEASABLE SKI BINDING

[75] Inventor: Martin Bogner, Ostfildern, Fed. Rep. of Germany

[73] Assignee: GEZE Sport International GmbH, Fed. Rep. of Germany

[21] Appl. No.: 642,423

[22] Filed: Jan. 17, 1991

[30] Foreign Application Priority Data

Jan. 24, 1990 [DE] Fed. Rep. of Germany ..... 4001950

[51] Int. Cl.[5] ..... A63C 9/08

[52] U.S. Cl. ..... 280/629; 280/630; 280/634

[58] Field of Search ..... 280/623, 629, 630, 634, 280/636

[56] References Cited

U.S. PATENT DOCUMENTS 3,877,711 4/1975 Koehler ..... 280/630
4,480,850 11/1984 Schneider ..... 280/630

FOREIGN PATENT DOCUMENTS 2214091 9/1973 Fed. Rep. of Germany .
8116269 2/1983 France .

*Primary Examiner*—Andres Kashnikow
*Assistant Examiner*—Richard Camby
*Attorney, Agent, or Firm*—Evenson, Wands, Edwards, Lenahan & McKeown

[57] ABSTRACT

A releasable ski binding is provided with a boot holder which can be swivelled around a vertical shaft and is pushed into a normal ski boot holding position by a piston. At its end facing the boot holder, the piston is arranged to be slidable into the transverse direction with play, and at its other end, the piston is arranged to be slidable in a guide almost without play. Thus, swivel motions of the boot holder can take place largely without friction between the boot holder and the piston parts which rest against it. At the same time, the normal position is defined virtually without play.

23 Claims, 2 Drawing Sheets

RELEASABLE SKI BINDING

BACKGROUND AND SUMMARY OF THE INVENTION

The invention relates to a releasable ski binding having a boot or sole holder which swivels around a ski-side vertical shaft when it is released. The boot or sole holder is pushed into its normal position which fixes the boot or the sole essentially firmly on the ski by means of a piston which is acted upon by spring force and which can be slid in the longitudinal direction of the ski inside a guide which is non-rotatable with respect to the vertical shaft. Projections and recesses on the boot-holder-side or sole-holder-side end of the piston are held in a centering engagement with recesses or projections of the boot holder or sole holder on both sides of a vertical plane containing the vertical shaft and extending in the longitudinal direction of the ski by mean of the spring force pushing against the boot holder or sole holder.

In ski bindings of this type, as they are known, for example, from the German Patent Document DE-AS 22 14 091 as well as from the French Patent Document FR-OS 25 11 602, the boot holder or sole holder as well as the piston in the normal position form a virtually rigid unit held together by the spring force which can carry out movements only within the scope of the play of the piston within the guide or of the play of the boot holder or sole holder on the vertical shaft. It is only when the forces acting upon the boot holder or sole holder are large enough for canceling the virtually rigid connection between the piston and the sole holder or boot holder caused by the spring force that the boot holder or sole holder can carry out a release swivel which is sufficient for the release of the boot and during which in each case one side of the boot holder or sole holder on one side of the above-mentioned vertical plane continues to be pushed by the piston into the direction of the normal position, while the respective other side of the boot holder or sole holder lifts off the piston and is no longer acted upon by forces.

In the case of the previously known bindings of the initially mentioned type, a comparatively high amount of friction, as a rule, must be expected during the release swivel between the binding elements moving relative to one another. The reason is that, in order to hold the boot holder or sole holder in the normal position with as little play as possible, the guide is dimensioned to be as narrow as possible in order to avoid a play of the piston in the transverse direction of the ski. As a result, considerable frictional resistances may occur between the piston and the guide because of even a slight accumulation of dirt and may counteract a sliding of the piston during the release swivel. It is an additional fact that the one side of the boot holder or sole holder which during the release swivel in each case remains in a force-locking contact with the piston, in the course of the release swivel, travels through a curved path and thus also carries out a movement in the transverse direction of the ski. However, the piston, in the case of the previous bindings cannot follow this component of movement in the transverse direction of the ski because of its bearing in the guide that is largely free of play in the transverse direction of the ski. Consequently, during the release swivel considerable relative movements having friction occur between one side of the boot holder or sole holder and the piston; i.e., the release swivel is counteracted by an additional considerable frictional resistance which is very dependent on dirt accumulations at the areas of the boot holder or sole holder and the piston which slide on one another.

Apart from the fact that frictional resistances which depend on the accumulation of dirt are undesirable because they result in a release action of the binding that is hard to reproduce, the friction causes a basically undesirable hysteresis within the elasticity range of the binding. This means that the forces which restore the boot holder or sole holder with a slight deflection within the elasticity range of the binding to the normal position under certain circumstances may clearly be lower than those forces on the boot side or sole side which previously have caused the deflection.

It is therefore an object of the invention to keep the internal friction of the binding as low as possible with minimal constructional expenditures.

In the case of a binding of the initially mentioned type this object is achieved in that the guide guides the piston without play in the transverse direction of the ski only in the are of its end which is away from the boot holder or sole holder, and the end of the piston which is on the boot holder or sole holder side, during the release swivel of the boot holder or sole holder, virtually without any force is able to follow at least a first section of a curved path through which the side of the boot holder or sole holder travels in each case which remains in an engagement with the piston in the respective release direction by way of the projection and the recess or the projections and the recesses.

The invention is based on the general idea of arranging the boot-holder-side or sole-holder-side end of the piston to be movable in the transverse direction of the ski so that the projection and the recess or the projections and the recesses which remain in an engagement during a release swivel of the boot holder or sole holder, only interact with one another in the manner of joint elements and correspondingly larger sliding movements are avoided between these elements relative to one another. As a result, the friction between the piston and the boot holder or sole holder can be reduced quite considerably.

As a result of this construction, essentially only the end of the piston that is away from the boot holder or sole holder is guided without any play which, by a corresponding construction of the binding, without any major expenditures, can be protected against becoming dirty so that the friction between the piston and the guide also becomes negligible.

According to a preferred embodiment of the invention, it is provided to construct the binding in such a manner that the projections and recesses in the normal position on the side of the boot are situated in a vertical plane containing the vertical shaft and extending in the transverse direction of the ski, in such a manner that, during the release swivel, projections and recesses remaining in an engagement with one another in each case on one side of the boot holder or sole holder, take up a position on the other side of this vertical plane during a maximal swivelling of the boot holder or sole holder and the distance from this vertical plane is approximately the same as in the normal position.

In this construction, the transverse movement of the boot-holder-side or sole-holder-side end of the piston which occurs during the release swivel of the boot holder or sole holder remains particularly slight. As a result, the friction, which may occur between the piston and the guide because of the transverse movement of one piston end, is kept particularly low.

It is also expedient for the guide to be open only on its boot-holder-side or sole-holder-side end—for the piston parts projecting out of the guide—, and the space between the guide and the boot holder or sole holder is closed off by a bellows-type covering.

Thus, it can be avoided in a constructively particularly simple manner that the elements which are essential for the release resistance of the binding become dirty.

In addition, it is preferably provided that the projections are constructed as narrow strips, wedges or the like which virtually only have line contact with the assigned recesses. This arrangement in connection with the transverse mobility of the boot-holder-side or sole-holder-side end of the piston results in an almost complete absence of friction between the piston and the boot holder.

Other objects, advantages and novel features of the present invention will become apparent from the following detailed description of the invention when considered in conjunction with the accompanying drawings.

DETAILED DESCRIPTION OF THE DRAWINGS

The illustrated binding, which is used for the holding of the front end of the sole of a ski boot which is not shown, has a base plate 1 which is fastened while resting on the top side of a ski and which, in the direction of the ski, changes toward the front in one piece into a housing 2 and is firmly connected with it in a condition where it is mounted on the ski.

A pin 3 which is approximately parallel to the vertical shaft of the ski is arranged in the center of the ski on the base plate 1 in the transition area to the housing 2. A boot holder or sole holder 4 can be swivelled on this pin 3. In a manner that is known in principle, this boot holder or sole holder 4 has legs 4' which laterally reach slightly around the front sole area of the ski boot and which have an edge 4'' which reaches over the boot sole from above.

Thus, by means of the legs 4', when the boot holder or sole holder 4 is held fast, the front part of the ski boot can be held fast in the transverse direction of the ski, while the edge 4'' interacts with the base plate for the vertical holding of the ski boot.

Figure 1:
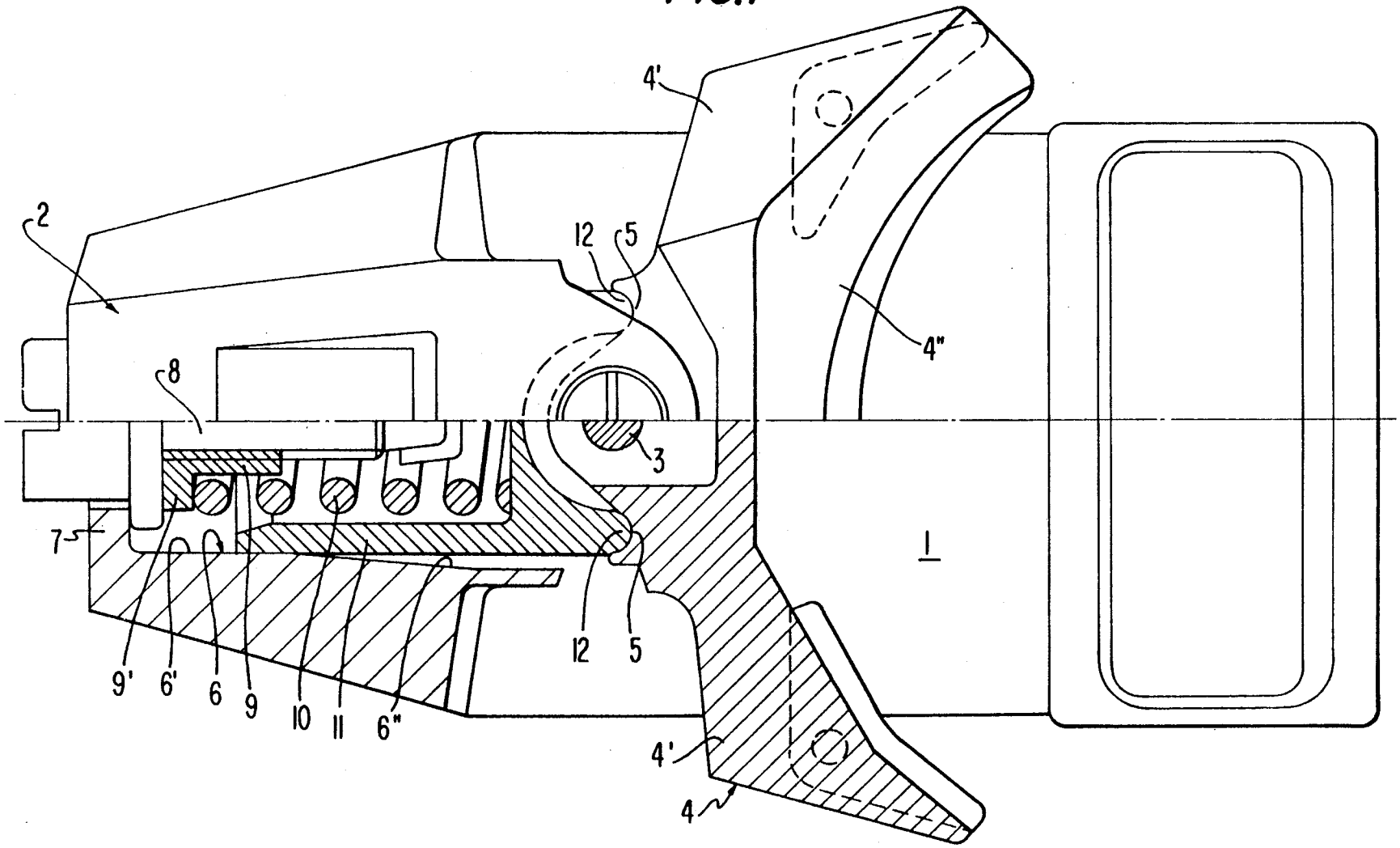
FIG. 1 is a top view of a binding according to the invention, the half of the binding which is on the bottom in the figure being a horizontal sectional view at the level of the piston axis.

On both sides of the pin 3, the boot holder or sole holder 4, on its side facing the housing 2, has channels or grooves 5 which are approximately parallel to the axis of the pin 3 and which preferably are constructed such that a plane extending tangentially with respect to the bottoms of both channels or grooves 5 is displaced to the right (with the drawing FIG. 1 viewed with the sectioned section on the bottom) in the drawing with respect to a plane which contains the axis of the pin 3 and extends in the transverse direction of the ski, when the boot holder or sole holder 4 takes up its shown normal or central position.

Inside the housing 2, a bore 6 is arranged which extends in the longitudinal direction of the ski and which, at its end which is on the left in the drawing, has a cylindrical section 6' with a uniform cross-section. This section 6' is followed toward the right by a section 6'' which, at least in the transverse direction of the ski, widens conically in the direction of the boot holder or sole holder 4.

The bore 6 is open in the direction of the boot holder or sole holder 4. At the other end of the bore 6, a flange-type collar 7 is constructed on the housing 2 which encloses a center opening in a ring-shaped manner. The head of an adjusting screw 8 projects through this center opening and, on the inner side of the collar 7, has a ring web molded to the screwhead which is capable of placing itself or supporting itself on the inner side of the collar 7 in the illustrated manner. A threaded sleeve 9 is arranged on the thread part of the adjusting screw 8 and has a flange 9' which, by means of a radial extension which is not shown, engages in an axial groove in the wall of the bore 6 which is not visible in the drawing and thus is held fast on the threaded section of the adjusting screw 8 so that it can be adjusted by screwing but cannot be turned relative to the housing 2. If the adjusting screw 8 is turned by means of a screwdriver relative to the housing 2, the threaded sleeve 9 is displaced in the axial direction of the adjusting screw 8 relative to the housing 2.

The threaded sleeve 9 or its flange 9' are used as a housing-side abutment for one end of a helical pressure spring 10, the other end of which is tensioned against the bottom of a hollow piston 11 which is arranged in the bore 6.

The piston 11 has a sufficient axial length in such a manner that the piston end facing away from the boot holder or sole holder 4 projects into the section 6' of the bore 6 when the piston—as illustrated—by means of web-type strips 12 molded onto it, in the normal or central position of the boot holder or sole holder 4, rests on the bottoms of both channels or grooves 5 of the boot holder or sole holder 4. The cross-section of the piston 11 is adapted to the cross-section of section 6' of the bore 6, at least in the transverse direction of the ski, in such a manner that the end of the piston 1 that is on the left in the drawing, in section 6', is guided practically without any play in the transverse direction of the ski.

As a result of the conical widening of section 6'' of the bore 6, on the other hand, the end of the piston 11 which is one the right in the drawing can be moved in the transverse direction of the ski, in which case the piston 11, when its right end is moved in the transverse direction of the ski, carries out a swivel motion around a vertical shaft of the ski which penetrates the other piston end.

The illustrated binding operates as follows:

According to the axial adjustment of the threaded sleeve 9 on the thread part of the adjusting screw 8, the helical pressure spring 10 has a more o less extensive pretensioning by means of which the piston 11, in the shown normal or central position of the boot holder or sole holder 4, is braced against the boot holder or sole holder 4, and the channels or grooves 5 as well as the web-shaped strips 12 are held in a mutual engagement.

As long as only limited moments with respect to the axis of the pin 3 act upon the boot holder or sole holder 4, the pretensioning of the helical pressure spring 10 will be sufficient for holding the piston rigid 11 relative to the boot holder or sole holder 4; i.e., the boot holder or sole holder 4 and the piston 11 remain immobile relative to one another and form a common movable unit.

Because of the negligible play of the left end of the piston 11 in the transverse direction of the ski within section 6' of the bore 6, the boot holder or sole holder 4 in this case can carry out no swivelling motion on the pin 3. The normal position or central position of the boot holder or sole holder 4 is therefore defined without any play.

As soon as torques affect the boot holder or sole holder 4 with respect to the axis of the pin 3 which exceed a threshold value preset by the pretensioning of the helical pressure spring 10, the boot holder or sole holder 4 carries out a swivel motion with respect to the axis of the pin 3, in which case, one of the web-type strips 12 of the piston 11, in each case, emerges from the assigned channel or groove 5 of the boot holder or sole holder 4 while the respective other strip 12 remains in an engagement with the channel or groove 5 assigned to it. In this case, the piston 11 is simultaneously pushed into the bore 6 with an increasing compression of the helical pressure spring 10.

Because of the swivelling of the boot holder or sole holder 4, the channel or groove 5 remaining in an engagement with the assigned strip 12 travels through a curved path which the assigned strip 12 and therefore the end of the piston 11 facing the boot holder or sole holder 4 can follow virtually without any force because the right end of the piston 11, as a result of the conicity of section 6'' of the bore 6, is sufficiently transversely movable at least within a limited swivel range of the boot holder or sole holder 4 which forms the elasticity range of the binding.

In the case of a limited swivelling of the boot holder or sole holder 4, the end of the ski boot or of the shoe sole held by it is not yet released. On the contrary, the boot holder or sole holder 4, in the case of a return swivel caused by the spring-loaded piston 11, can guide the ski boot back into the normal or central position.

In the case of larger swivel movements of the boot holder or sole holder 4, that is, when the elasticity range of the binding is exceeded, the shoe is released.

An only negligible friction occurs between the strips 12 and the channels or grooves 5 because virtually in all swivel positions of the boot holder or sole holder 4, there exists only an approximated line contact, and because of the transverse mobility of the right end of the piston 11 at least within the elasticity range of the binding, there is virtually no sliding friction between the strips 12 and the channels or grooves 5 because the strips 12 carry out a virtually pure rolling motion relative to the channels or grooves 5.

Between the left end of the piston 11 and the section 6' of the bore 6, only a very slight friction will also occur because there is not much likelihood that section 6' ma become dirty. A penetration of dirt into this section is prevented by the large distance between the opening of the bore 6 facing the boot holder or sole holder 4 as well as a bellows-type covering which is not shown and which closes off the space between the boot-holder-side or sole-holder-side edge of the bore 6 and the boot holder or sole holder 4.

The binding illustrated in the drawing may be modified in multiple ways.

Figure 1A:
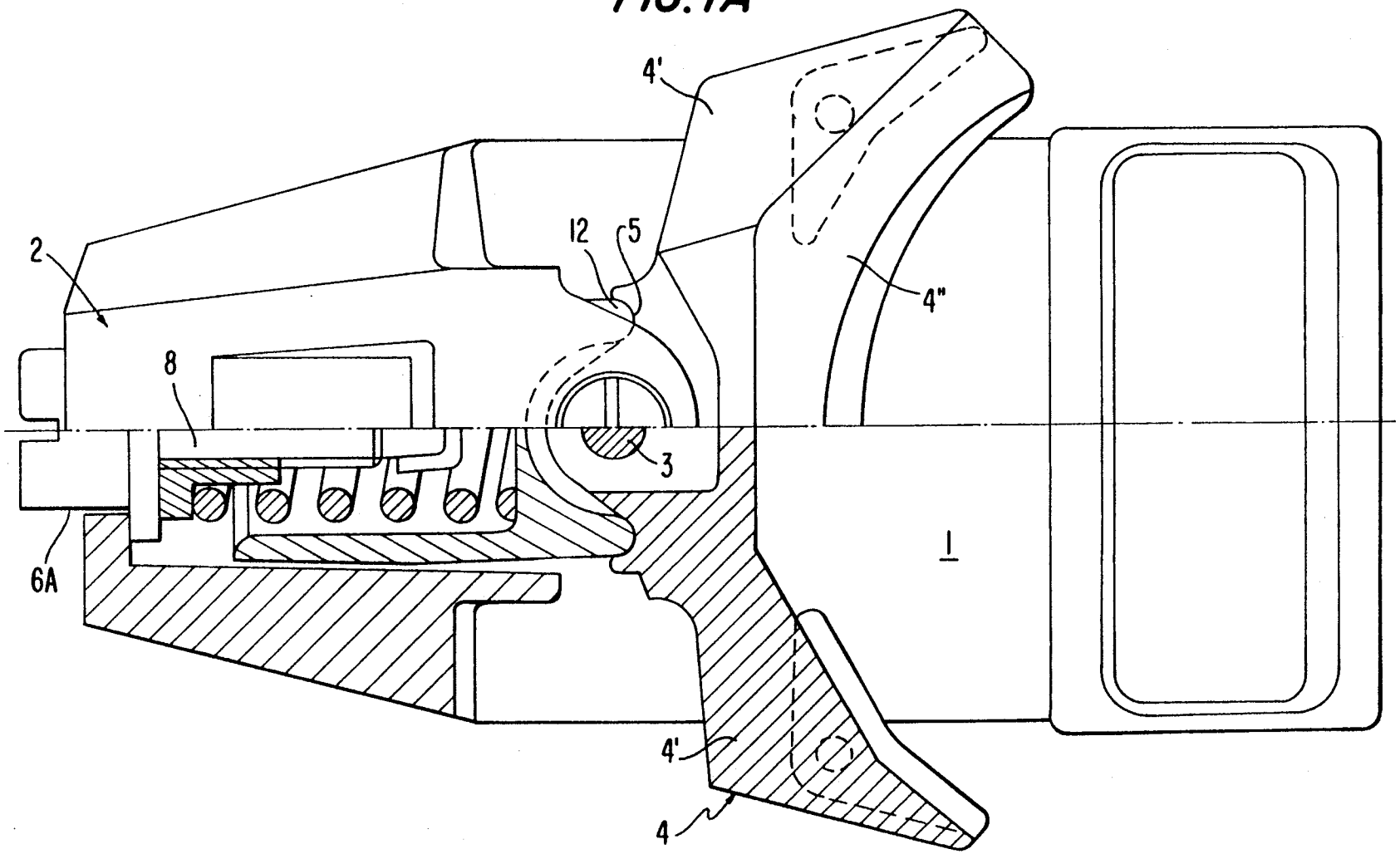
FIG. 1A is a partial sectional top view of a part of a binding constructed according to another preferred embodiment of the invention.

It is possible, for example, as shown in FIG. 1A, to construct the whole bore 6A to be cylindrical with a uniform cross-section, and to construct the piston 11A to be conical with a tapering in the direction of the boot holder or sole holder 4 in order to permit the desired transverse mobility of the right piston end while, at the same time, a guiding of the other piston end is ensured which has no play in the transverse direction of the ski.

In addition, the strips 12 may be arranged on the boot holder or sole holder 4, and the channels or grooves 5 may be arranged at the piston 4.

It is also possible to construct the boot holder or sole holder 4 in two parts in the manner of tongs, in which case each part may possibly be disposed so that it can be pivoted around its own pin 3.

Finally, the boot holder or sole holder 4 may be arranged so that it can also be swivelled around a transverse axis in order to possibly permit the release of a ski boot in the upward direction by means of a swivel around this transverse axis—without any swivelling about an axis that is parallel to the vertical shaft of the ski.

Basically, the shown binding may also be used for holding the heel of a ski boot.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A releasable ski binding comprising:

a boot holder part clampingly engageable with a ski boot or ski boot sole holder, a vertical pivot mount for mounting the boot holder part at a ski and for permitting swivelling movement of the boot holder part about a vertical pivot axis between a normal skiing position clampingly holding the ski boot and a release position permitting release of the ski boot, a piston abuttingly engageable with the boot holder part to resist movement of the boot holder part from the normal skiing position while permitting such movement in response to a predetermined force from the boot holder part during swivelling movement thereof, and a guide surface arrangement for guiding movement of the piston during swivelling movement of the boot holder part, said guide surface arrangement including a first guide section with interengageable sliding surfaces for guiding the piston substantially without play in the transverse direction of the ski only in an area of the piston disposed away from its end area engageable with the boot holder part and a second guide section adjacent said end area which permits slight transverse movement of an area of the piston adjacent said end area during longitudinal movement of the piston when the boot holder part is swivelled toward its release position.

2. A releasable ski binding according to claim 1, wherein said piston and boot holder part include respective interengageable portions at first and second opposite sides of a longitudinal axis of a ski when the boot holder is mounted in an in-use position on a ski, said interengageable portions being configured such that the interengageable portions at the first side of the longitudinal axis are disengaged from one another during pivotal movement of the boot holder part while the interengageable portions at the second side remain in guiding contact with one another in a one-sided engagement, and wherein said piston is a hollow piston arranged in a housing bore with said guide surface arrangement including interengaging sliding surfaces at the bore and the piston which together form the first guide section.

3. A releasable ski binding according to claim 2, wherein said interengageable portions include respective recesses in the boot holder part and projections on the piston.

4. A releasable ski binding according to claim 2, wherein a spring is provided for continuously biasing the piston toward the boot holder part.

5. A releasable ski binding according to claim 2, wherein said interengaging sliding surfaces at the bore and the piston which together form the first guide section are collinear.

6. A releasable ski binding according to claim 2, wherein the end of the piston which is away from the boot holder means has a larger width in the transverse direction of the guide surface arrangement than the other end of the piston.

7. A releasable ski binding according to claim 2, wherein the width of a gap between guide surfaces on the bore and boot holder part increases in the direction of the sole holder or boot holder means.

8. A releasable ski binding according to claim 3, wherein a spring is provided for continuously biasing the piston toward the boot holder part.

9. A releasable ski binding according to claim 4, wherein said interengageable portions include respective recesses in the boot holder part and projections on the piston means.

10. A releasable ski binding according to claim 3, wherein the one-sided engagement is also maintained in the case of a maximal release swivel of the boot holder part.

11. A releasable ski binding according to claim 3, wherein the projections and recesses in the normal position, on the side of the boot holder part, are situated in a vertical plane which contains the vertical pivot mount and extends in the transverse direction of the ski, in such a manner that the projections and recesses which remain in an engagement with one another during the release swivel, in each case, on one side of the boot holder or sole holder, in the case of a maximal swivelling of the boot holder or sole holder, take up a position on the other side of this vertical plane, and the distance from this vertical plane is approximately equally large as in the normal position.

12. A releasable ski binding according to claim 2, wherein the piston has a length that is large in comparison to its width.

13. A releasable ski binding according to claim 2, wherein the boot holder part is in one piece.

14. A releasable ski binding according to claim 2, wherein the guide surface arrangement of the housing bore is arranged on the ski in a fixed manner.

15. A releasable ski binding according to claim 2, wherein the bore is essentially open only at its boot holder part side end for accommodating the portion of the piston that project out of the first guide section, and wherein the space between the bore and the boot holder part is closed off by a bellows-type covering.

16. A releasable ski binding according to claim 5, wherein said collinear surfaces are cylindrical surfaces.

17. A releasable ski binding according to claim 3, wherein the projections are constructed as narrow strips, wedges or the like which virtually have only line contact with the assigned recesses.

18. A releasable ski binding according to claim 11, wherein said interengageable portion include respective recesses in the boot holder part and projections on the piston.

19. A releasable ski binding according to claim 18, wherein the one-sided engagement is also maintained in the case of a maximal release swivel of the boot holder part.

20. A releasable ski binding according to claim 18, wherein the end of the piston which is away from the boot holder means has a larger width in the transverse direction of the guide surface arrangement than the other end of the piston.

21. A releasable ski binding according to claim 9, wherein the bore is essentially open only at its boot holder part side end for accommodating the portion of the piston that project out of the first guide section, and wherein the space between the bore and the boot holder part is closed off by a bellows-type covering.

22. A releasable ski binding comprising:

boot holder means clampingly engageable with a ski boot or ski boot sole holder, vertical pivot mount means for mounting the boot holder means at a ski and for permitting swivelling movement of the boot holder means about a vertical pivot axis between a normal skiing position clampingly holding the ski boot and a release position permitting release of the ski boot, piston means abuttingly engageable with the boot holder means to resist movement of the boot holder means from the normal skiing position while permitting such movement in response to a predetermined force from the boot holder means during swivelling movement thereof, and guide means engageable with the piston means for guiding movement of the piston means during swivelling movement of the boot holder means, said guide means including a first guide section for guiding the piston means substantially without play in the transverse direction of the ski only in an area of the piston means disposed away from its end area engageable with the boot holder means and a second guide section adjacent said end area which permits slight transverse movement of an area of the piston means adjacent said end areas during longitudinal movement of the piston means when the boot holder means is swivelled toward its release position, wherein the end of the piston means which is away from the boot holder means has a larger width in the transverse direction of the guide means than the other end of the piston means.

23. A releasable ski binding comprising:

boot holder means clampingly engageable with a ski boot or ski boot sole holder, vertical pivot mount means for mounting the boot holder means at a ski and for permitting swivelling movement of the boot holder means about a vertical pivot axis between a normal skiing position clampingly holding the ski boot and a release position permitting release of the ski boot, piston means abuttingly engageable with the boot holder means to resist movement of the boot holder means from the normal skiing position while permitting such movement in response to a predetermined force from the boot holder means during swivelling movement thereof, and guide means engageable with the piston means for guiding movement of the piston means during swivelling movement of the boot holder means, said guide means including a first guide section for guiding the piston means substantially without play in the transverse direction of the ski only in an area of the piston means disposed away from its end area engageable with the boot holder means and a second guide section adjacent said end area which permits slight transverse movement of an area of the piston means adjacent said end area during longitudinal movement of the piston means when the boot holder means is swivelled toward its release position, wherein said piston means and boot holder means include respective interengageable means at first and second opposite sides of a longitudinal axis of a ski when the boot holder means is mounted in an in-use position on a ski, said interengageable means being configured such that the interengageable means at the first side of the longitudinal axis are disengaged from one another during pivotal movement of the boot holder means while the interengageable means at the second side remain in guiding contact with one another in a one-sided engagement, wherein a spring is provided for continuously biasing the piston means toward the boot holder means, wherein said interengageable means include respective recesses in the boot holder part and projections on the piston means, wherein the guide means are formed at a bore which is essentially open only at its boot holder means side end for accommodating the parts of the piston means that project out of the guide means and wherein the space between the guide means and the boot holder means is closed off by a bellows-type covering.

* * * * *